US012220037B2

(12) United States Patent
Ezzina et al.

(10) Patent No.: US 12,220,037 B2
(45) Date of Patent: Feb. 11, 2025

(54) REFILLABLE CASE FOR POWDER COSMETIC PRODUCT

(71) Applicant: ALBEA SERVICES, Gennevilliers (FR)

(72) Inventors: Emir Ezzina, Gennevilliers (FR); Mélodie Bazinval, Gennevilliers (FR)

(73) Assignee: ALBEA SERVICES, Gennevilliers (FR)

( * ) Notice: Subject to any disclaimer, the term of this patent is extended or adjusted under 35 U.S.C. 154(b) by 245 days.

(21) Appl. No.: 17/872,639

(22) Filed: Jul. 25, 2022

(65) Prior Publication Data

US 2023/0147837 A1 May 11, 2023

(30) Foreign Application Priority Data

Nov. 9, 2021 (FR) ..... 2111870

(51) Int. Cl.
*A45D 33/02* (2006.01)
*A45D 33/00* (2006.01)

(52) U.S. Cl.
CPC ..... *A45D 33/003* (2013.01); *A45D 2200/05* (2013.01)

(58) Field of Classification Search
CPC ..... A45D 33/16; A45D 33/003; A45D 33/02; A45D 33/025; A45D 33/006; A45D 2200/05; A45D 33/00
USPC ..... 220/23.87, 23.89; 206/581
See application file for complete search history.

(56) References Cited

U.S. PATENT DOCUMENTS 5,938,016 A * 8/1999 Erdtmann ..... A45D 40/0068 220/495.08
6,173,719 B1 * 1/2001 Petit ..... A45D 33/24 206/823
2007/0029226 A1 * 2/2007 Yuhara ..... A45D 33/24 206/823

(Continued)

FOREIGN PATENT DOCUMENTS

FR 3086850 * 4/2020 ..... A45D 40/06
FR 3086850 A1 4/2020
WO 2016194473 A1 12/2016

(Continued)

OTHER PUBLICATIONS

French Application No. FR 2111870, "Search Report," Jun. 1, 2022, 2 pages.

*Primary Examiner* — Don M Anderson
*Assistant Examiner* — Elizabeth J Volz
(74) *Attorney, Agent, or Firm* — Kilpatrick, Townsend & Stockton LLP

(57) ABSTRACT

The invention relates to a case for powder cosmetic product comprising a base which comprises:

- a pedestal comprising a housing comprising a cylindrical wall and an annular bearing face;
- a container releasably received in the housing and comprising a rim that rests on the bearing face;
- a ring for attaching the container by tightening the rim of the container against the bearing face; characterised in that the cylindrical wall comprises two indentations for access to the rim of the container, the ring being attached in the housing, two lateral faces of the attachment ring being accessible through the indentations, the attachment ring comprising means of angular indexing by cooperation with the indentations.

12 Claims, 7 Drawing Sheets

(56) References Cited

U.S. PATENT DOCUMENTS

2008/0230436 A1* 9/2008 Martins ..... A45D 33/006
220/838

FOREIGN PATENT DOCUMENTS

WO WO2016194473 * 12/2016 ..... A45D 33/00
WO 2021058518 A1 4/2021
WO WO2021058518 * 4/2021 ..... A45D 40/00

* cited by examiner

[Fig.1]
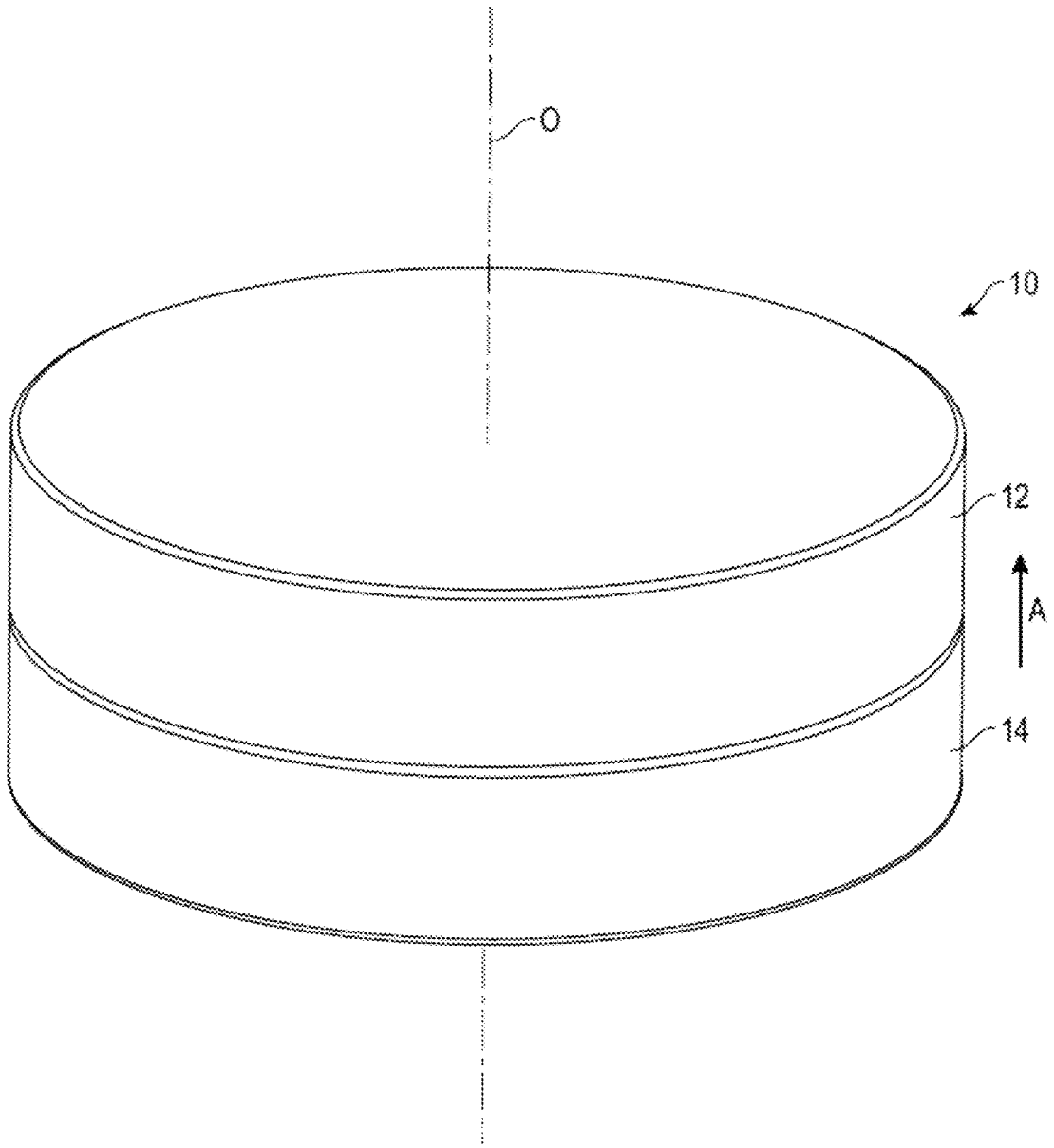

[Fig.2]
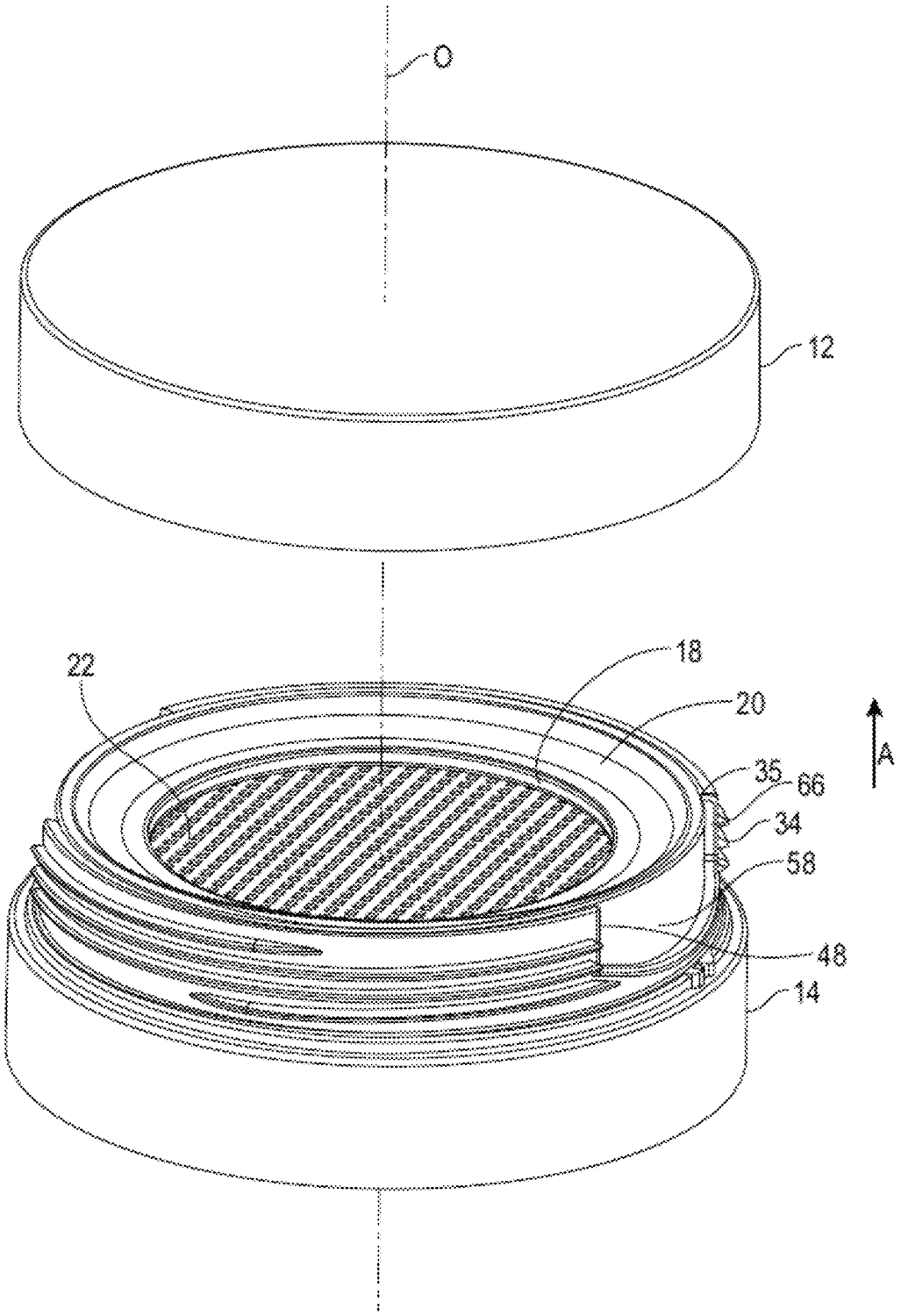

[Fig.3]
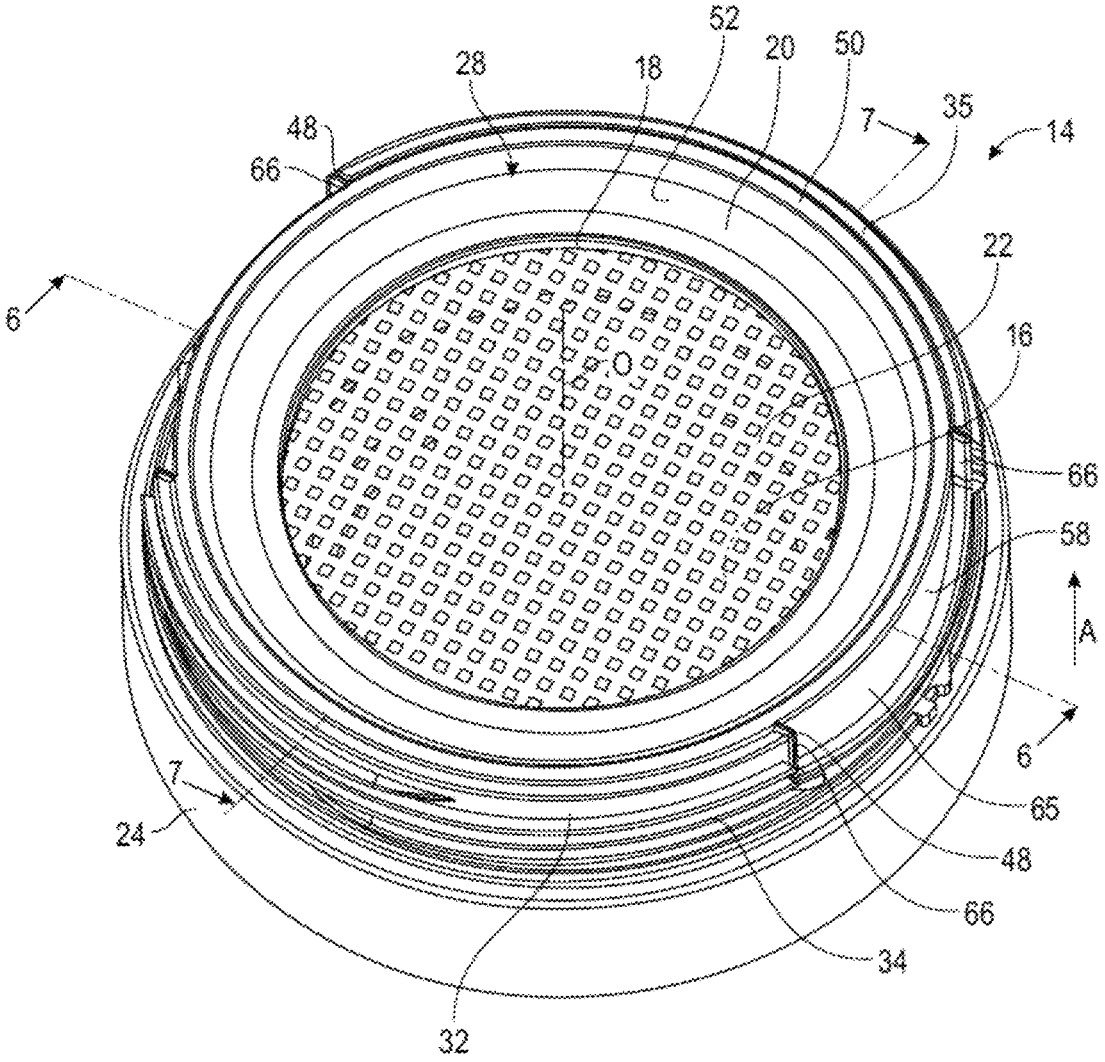

[Fig.4]
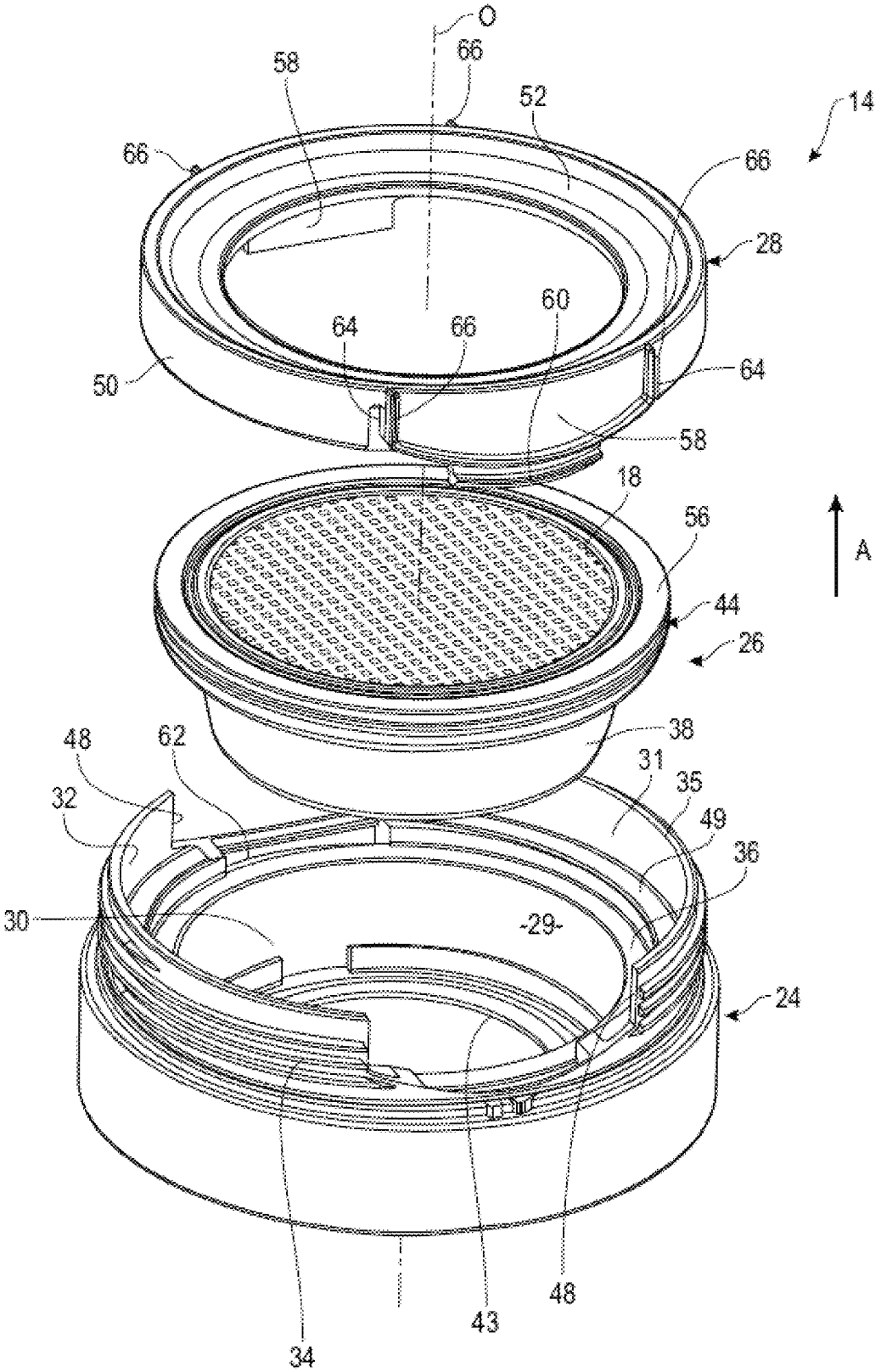

[Fig.5]
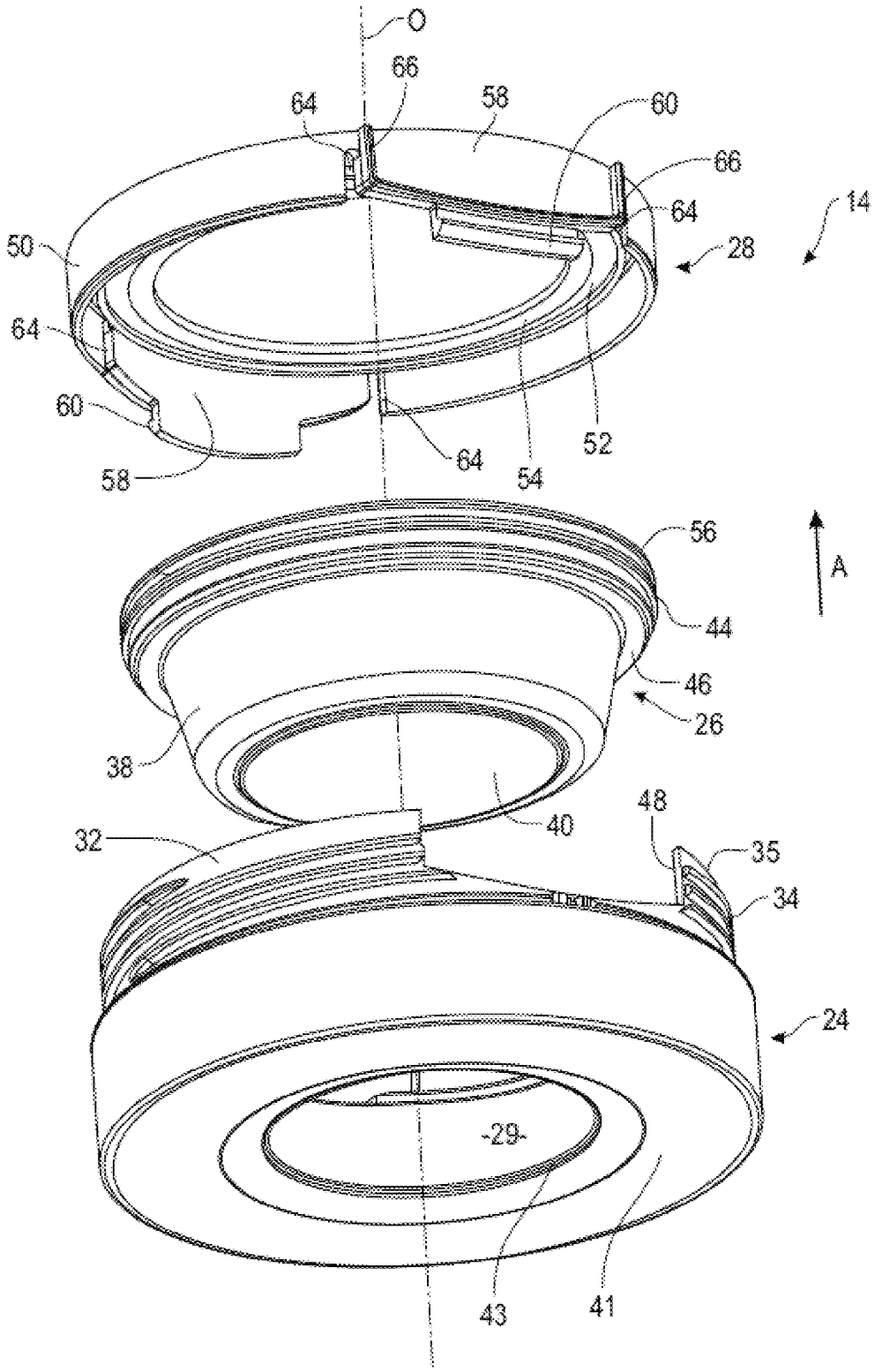

[Fig.6]
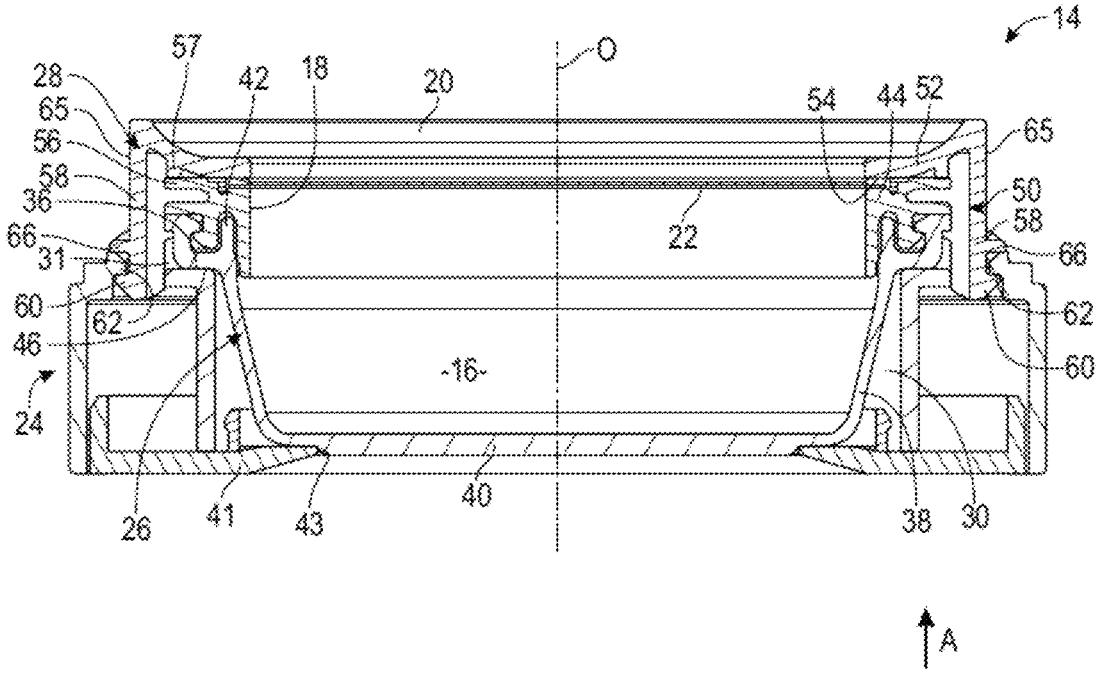

[Fig.7]
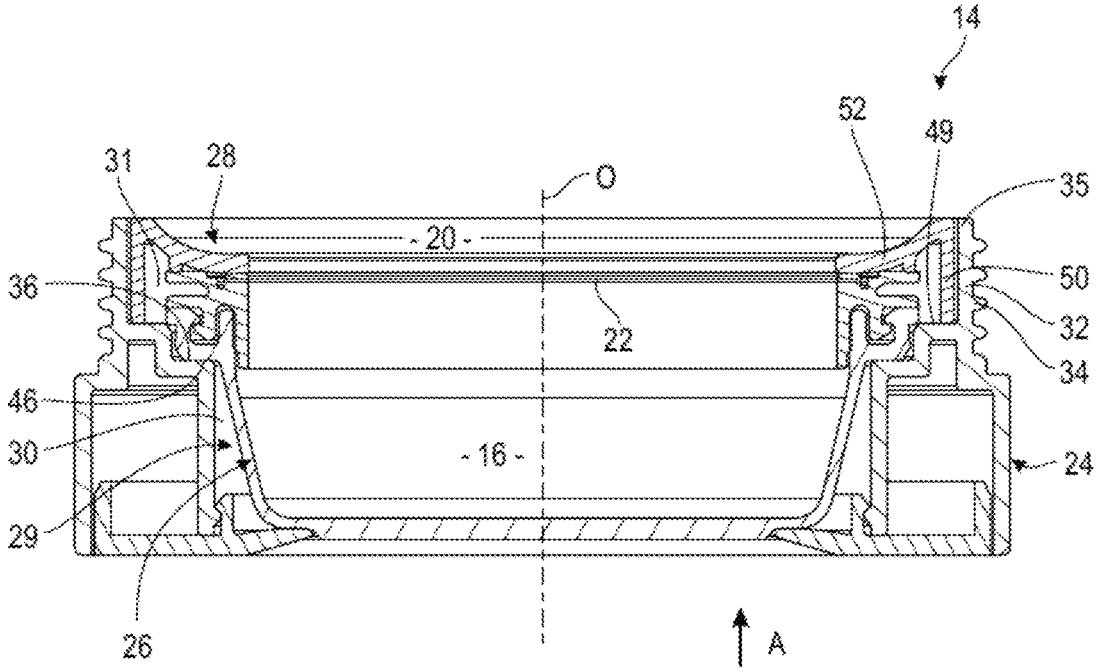

REFILLABLE CASE FOR POWDER COSMETIC PRODUCT

CROSS-REFERENCE TO RELATED APPLICATION

This application is related to and claims priority benefits from French Application No. 2111870, filed Nov. 9, 2021 and titled NOM ET ADRESSE DU DEMANDEUR OU DU MANDATAIRE À QUI LA CORRESPONDANCE DOIT ÊTRE ADRESSÉE, the entire content of which is incorporated herein by this reference.

TECHNICAL FIELD OF THE INVENTION

The invention relates to a powder cosmetic product case comprising a base and a cover for closing the base, the base comprising:

- a pedestal comprising a housing opening axially upwards, an upper section of the housing being delimited radially by a cylindrical wall and axially downwards by an annular bearing face;
- a container enclosing a cavity which contains said product, the container being releasably received in the housing, the container comprising an axial opening surrounded by a rim which rests on the bearing face;
- a ring for attaching the container by tightening the rim of the container against the bearing face.

TECHNICAL BACKGROUND

Various examples of the design of a case (or container) for receiving a powder cosmetic product, such as loose powder or similar products used for make-up, are known from the prior art.

In particular, cases are known in which the cavity containing the cosmetic product is delimited by flexible walls so that a bottom wall of the cavity can be lifted without significant effort by the finger of a user. This allows the desired amount of cosmetic product to be fed to a sifter that is stretched into the opening of the cavity.

Such a cavity is very advantageous because it allows the desired amount of cosmetic product to be obtained without the risk of spilling it next to the case and without any particular effort. In addition, such a cavity allows access to almost all of the cosmetic product present in the cavity.

In addition, to preserve the environment as much as possible, it is preferable to avoid having to repurchase an entire case when you want to renew or change your cosmetic product.

In order to solve this problem, it has already been proposed to realize the cases that can be refilled with cosmetic product containers. Such containers comprise little material and are therefore easier to manufacture and recycle.

However, the current containers have sufficiently rigid walls to be easily handled during their replacement and to properly hold the cosmetic product during its use.

There is a need to easily and cleanly replace containers with a wall that is too flexible to be handled without deformation in the existing cases.

SUMMARY OF THE INVENTION

The invention relates to a case for powder cosmetic product comprising a base and a cover for closing the base, the base comprising:

- a pedestal comprising a housing opening axially upwards, an upper section of the housing being delimited radially by a cylindrical wall and axially downwards by an annular bearing face;
- a container enclosing a cavity which contains said product, the container being releasably received in the housing, the container comprising an axial opening surrounded by a rim which rests on the bearing face;
- a ring for attaching the container by tightening the rim of the container against the bearing face;

The case is characterised in that the cylindrical wall comprises at least two opposite indentations which give access to at least the rim of the container, the ring being attached by removable attachment means in the housing, two lateral faces for gripping the attachment ring being accessible through the indentations, the attachment ring comprising means of angular indexing of the attachment ring by cooperation with the indentations.

According to another aspect of the invention, the ring is attached to the pedestal by attachment means by snap fitting in an axial direction.

According to another aspect of the invention, the ring comprises two axial extension tabs which are elastically deformable in flexion and which are intended to be snap fitted with two notches carried by the pedestal to form said attachment means by snap fitting.

According to another aspect of the invention, the notches are arranged in line with the indentations, each tab having an upper segment comprising the gripping face which is arranged in coincidence with an associated indentation, the tabs being capable of being constrained towards a state of disengagement of the notches by radial pinching of their upper segment through the indentations.

According to another aspect of the invention, the angular indexing means comprise at least one projection extending from the gripping face of each tab and intended to be axially nested with the associated indentation.

According to another aspect of the invention, the container comprises a flexible sifter that is stretched across its opening.

According to another aspect of the invention, the sifter is attached to the rim of the container by means of a frame.

According to another aspect of the invention, the frame has a sealing lip at its periphery against which the ring is intended to be tightened.

According to another aspect of the invention, the container has at least one wall that is sufficiently flexible so that a bottom wall of the container can be easily lifted by the finger of a user up to come into contact with the sifter.

According to another aspect of the invention, the bottom of the pedestal has a window for access to the bottom wall of the container.

According to another aspect of the invention, the attachment ring is housed over its entire height in the cylindrical wall of the pedestal hiding a peripheral wall of the attachment ring.

According to another aspect of the invention, the gripping face is formed by a segment of the peripheral wall.

BRIEF DESCRIPTION OF THE FIGURES

Further characteristics and advantages of the invention will become apparent from the following detailed description, for the understanding of which reference is made to the attached drawings which are briefly described below.

FIG. 1 is a perspective view of a case realized according to the teachings of the invention, the case occupying a closed position.

FIG. 2 is a perspective view of the case in FIG. 1, the case occupying an open position.

FIG. 3 is a larger scale view showing the top of a base of the case of FIG. 1 in perspective.

FIG. 4 is an exploded perspective view showing the various components of a base of the case of FIG. 1 from a first viewing angle.

FIG. 5 is a view similar to FIG. 4 that depicts the various components of a base of the case of FIG. 1 from a second viewing angle.

FIG. 6 is an axial cross-sectional view along the cross-sectional plane 6-6 of FIG. 3.

FIG. 7 is an axial cross-sectional view along the cross-sectional plane 7-7 of FIG. 3.

DETAILED DESCRIPTION OF THE INVENTION

In the following description, elements with identical structure or similar functions will be referred to by the same reference.

In the remainder of the description, an axial orientation parallel to a main axis of the case, and indicated by the arrow "A" which is directed from bottom to top, will be adopted. Radial orientations extending radially with respect to the main axis of the case from the inside to the outside will also be adopted. Tangential orientations that are orthogonal to the axial and radial orientations will also be adopted.

In the embodiments of the case shown in the figures, said main axis constitutes an axis of rotation for screwing the cover onto a base of the case.

The terms "top" and "bottom", "above" and "below", "upper" and "lower" are used as geometric reference frame in relation to the axial orientation as shown in the figures and independently of the direction of the gravity of the earth.

FIG. 1 shows a case 10 for a powder cosmetic product in closed position, and FIG. 2 shows the same case 10 in open position.

A powder cosmetic product is for example loose powder to be used for make-up. For example, it is a powder cosmetic product applied to the face with an applicator (not shown), in particular by means of a brush or a sponge (or any other equivalent means).

Preferably, the powder cosmetic product is intended to be applied by means of a brush which is here separate from said case 10.

The case 10 of powder cosmetic product comprises at least one cover 12 and a base 14 that are movably mounted relative to each other between at least one closed position, shown in FIG. 1, and an open position of the case 10, shown in FIG. 2, in which the cover 12 is removed from the base 14.

The cover 12 is intended to be screwed onto an associated thread 34 of the base 14. The case 10 has a main axis O determining the axial direction. The base 14 is located at the bottom and the cover 12 at the top. The cover 12 is more particularly intended to be screwed by rotation about the main axis O on the base 14.

The cover 12 and the base 14 have a complementary shape that gives the case 10 its aesthetic appearance, in particular in closed position.

In a non-limiting way, the case 10 has a general cylindrical shape of revolution centred on said main axis O.

Alternatively, the case could have another general shape, in particular a parallelepiped shape, in particular a square or rectangular shape.

Advantageously, the case 10 is a "compact" type case, i.e. sized so that it can be conveyed, in particular but not exclusively in a bag, for example a handbag of a user.

Preferably, the cover 12 is removable from the base 14, i.e., the cover 12 is separate from the base 14 in the open position of the case 10 as shown in FIG. 2.

Alternatively, the cover could be connected to the base by means of a flexible attachment allowing it to be screwed and unscrewed from the base.

The base 14 comprises a cavity 16 for receiving said product, visible for example in FIG. 6. The cavity 16 opens axially upwards through an opening 18 into an axially upwardly open bowl 20 outside the base.

A sifter 22 equipped with passage orifices of the product is arranged in the opening 18 to form a delimitation between the cavity 16 and the bowl 20.

As shown in more detail in FIGS. 4 and 5, the base 14 comprises several components assembled.

The base 14 comprises a pedestal 24, a container 26 and a ring 28 for attaching the container 26 in the pedestal 24. This configuration allows the container 26 to be replaced when it is empty or when a cosmetic product is desired to be changed in a clean and quick manner, while retaining the rest of the case 10. This configuration is therefore both economic and ecological.

For this purpose, the pedestal 24 comprises a housing 29. The housing 29 is divided into two sections. A lower section 30 of the housing 29 is intended to receive the container 26, while an upper section 31 of the housing 29 is intended to receive the bowl 20 allowing to collect the powder cosmetic product present on the sifter 22 by means of an applicator without risk of spilling it everywhere.

The upper section 31 of the housing 29 is radially delimited by a cylindrical wall 32. The cylindrical wall 32 comprises on its external face the thread 34 for screwing the cover 12. The cylindrical wall 32 comprises a free upper end edge 35.

At the junction between the lower section 30 and the upper section 31 of the housing 29, an annular bearing face 36 oriented axially upwardly is arranged. The annular bearing face 36 surrounds a passage to allow for housing the container 26 in the lower section 30 of the housing 29, as will be explained later. This bearing wall 36 is here formed by a shoulder, the diameter of the lower section 30 being smaller than the diameter of the upper section 31 of the housing 29.

Here, the container 26 encloses the cavity 16 which contains said cosmetic product. The container 26 is releasably received in the housing 29 of the pedestal 24.

The cavity 16 is delimited radially by a peripheral wall 38 and axially downward by a bottom wall 40, visible for example in FIG. 6. The sifter 22 is intended to be attached to an upper end edge 42 of the peripheral wall 38. The edge 42 radially delimits the axial opening 18 of the cavity 16 upward.

In the embodiment shown in the figures, at least one of the peripheral wall 38 and the bottom wall 40 is made of a material that is sufficiently flexible so that a user can lift the bottom wall 40 up to bring into contact with the sifter 22 by simply pressing on the bottom wall 40 with a finger of the hand. For this purpose, the housing 29 of the pedestal 24 is closed downward by a bottom 41 which is perforated with a window 43 for access to the bottom wall 40 of the container 26.

Such an arrangement thus allows the cosmetic product to be passed over the sifter 22 by lifting the bottom wall 40, without having to tip the container 26 to drop the cosmetic product.

The sifter 22 is a flexible sifter which is made, for example, in the form of a grid, of nylon or other material, consisting of a set of meshes each delimiting one of the orifices for the passage of the powder cosmetic product out of the cavity.

The sifter 22 is stretched across the opening 18 of the container 26. To maintain this tension despite the flexibility of the wall 38 of the container 26, the sifter 22 is here carried by a frame 44 of complementary shape to that of the outline of the opening 18, here of circular shape, centred on the main axis O. The frame 44 is made of a much stiffer material than the peripheral wall 38 and/or the bottom wall 40 of the container 26. The frame 44 is sufficiently rigid to maintain the tension in the sifter 22.

The frame 44 is for example made of a plastic material over-moulded on the periphery of the sifter 22.

The sifter 22 is mounted on the edge 42 of the container 26 by means of the frame 44. Specifically, the frame 44 is mounted by snap fitting on the upper edge 42 of the container 26. Thus, the container 26 and the sifter 22 are attached to each other to form a single component that is easy to house in the pedestal 24 and replace. The frame 44 allows the upper end of the peripheral wall 38 to be made more rigid. The container 26 thus maintains an opening 18 of same shape, in this case circular, at all times during the use of the case 10.

The container 26 further comprises a rim 46 that surrounds the opening 18, as shown in FIGS. 5 and 6. The rim 46 projects radially outwardly from the upper edge 42 of the peripheral wall 38. The frame 44 of the sifter 22 allows to provide structural rigidity to the peripheral wall 38 at the level of the edge 42, as well as at the level of the rim 46.

When the container 26 is positioned in its housing 29, it rests by means of its rim 46 which rests on the bearing face 36 of the pedestal 24, as shown in FIG. 6. The peripheral wall 28 is here entirely hidden by the pedestal 24.

Since the container 26 is very flexible, it would be complicated to extract it from the top of the housing 29 by exerting a pressure through the window 43 without spilling the remaining powder it contains to the outside. It is therefore preferable to be able to grip it by a more rigid portion, namely by the rim 46, made more rigid by the frame 44.

To allow the container 26 to be easily grasped by the frame 44 and/or the rim 46, the cylindrical wall 32 of the pedestal 24 comprises at least two radially opposed indentations 48 that provide access to at least the rim 46 of the container 26. The indentations 48 are realized in the upper edge 35 of the cylindrical wall 32. They extend downwards up to the face 36 of the bearing surface. Each indentation 48 allows a user to grasp the rim 46 by squeezing it diametrically with the pads of two fingers.

The attachment ring 28 of the container 26 is attached by releasably attachment means in the housing 29 by tightening the rim 46 of the container 26 against the bearing face 36, as shown in FIG. 6. The ring 28 thus holds the container 26 firmly in its housing 29.

The attachment ring 28 comprises a peripheral wall 50 that has an external diameter slightly smaller than the internal diameter of the cylindrical wall 32 of the pedestal 24 so that the ring 28 is received in the upper section 31 of the housing 29 with a radial clearance that allows it to be mounted and dismounted, as shown in FIG. 3. Because the ring 28 is received in the cylindrical wall 32, it does not interfere with the thread 34 located on the external face of the cylindrical wall 32, as shown in FIG. 7.

The peripheral wall 50 is received in a peripheral interstice that is reserved between the rim 46 of the container 26 and the cylindrical wall 32 of the pedestal 24.

A lower end edge of the peripheral wall 50 of the attachment ring 28 is here intended to come into contact of an annular shoulder face of the upper section 31 of the housing 29 which is staged above outwardly relative to the bearing face 36 when the attachment ring 28 is mounted in the pedestal 24.

The attachment ring 28 also comprises an annular upper wall 52 inclined in the direction of the opening 18 of the container 26 that radially delimits the bowl 20. The upper wall 52 extends radially inward from an upper end edge of the peripheral wall 50. The upper wall 52 thus forms a funnel that allows the cosmetic product to slide towards the sifter 22. For this purpose, the upper wall 52 has an inner diameter that is approximately equal to the diameter of the sifter 22.

The attachment ring 28 is housed over its entire height in the cylindrical wall 32 of the pedestal 24, i.e., it does not protrude above the upper edge 35 of the cylindrical wall 32. To this end, the attachment ring 28 here has a height less than or equal to the height between the shoulder face 49 and the upper end edge 35 of the cylindrical wall 32 of the pedestal 24. The peripheral wall 50 is thus hidden by the cylindrical wall 32 of the pedestal 24. Thus, only the upper face of the upper wall 52 of the attachment ring 28 is visible.

As illustrated in FIGS. 5 and 6, the upper wall 52 has a lower annular face 54 which is intended to press against the rim 46 of the container 26 around its entire periphery when the attachment ring 28 is mounted in the pedestal 24. Here, the annular face 54 presses against the rim 26 by means of the frame 44 of the sifter 22. Thus, the attachment ring 28 holds the container 26 firmly in position in its housing 29. The rim 46 is tightened axially between the attachment ring 28 and the bearing face 36.

The attachment ring 28 is mounted in a sealing manner around the container 26. To this end, the frame 44 has a flexible sealing lip 56 that extends radially outward from the circumference of the frame 44. An annular bead 57 extending from a lower face of the upper wall 52 of the attachment ring 28 is intended to tightly come into contact axially against the lip 54 to ensure a good sealing preventing the cosmetic product from passing between the container 26 and the attachment ring 28 when the attachment ring 28 is mounted on the pedestal 24.

The attachment ring 28 is here attached to the pedestal 24 by snap fitting attachment means in an axial direction. For this purpose, the attachment ring 28 comprises two axially extending attachment tabs 58 which are elastically deformable in flexion. Each attachment tab 58 is equipped at its free lower end with a crampon 60 which is intended to be fitted, here radially outwards, into a notch 62 of the pedestal 24. Thus, each attachment tab 58 is flexible between a fitting state of the clamp 60 in its notch 62, towards which it is elastically biased, as shown in FIG. 6, and a disengaged state, in which it is flexed radially inward and in which it is stressed against the elastic bias, not shown.

An upper segment of the attachment tabs 58, ensuring the connection with the rest of the ring 28, is formed by a portion of the peripheral wall 50 delimited, along the circumference of the ring 28, by two axial slits 64 which are made in the peripheral wall 50 and which open downwards, as shown in FIG. 5. These two slits 64 thus promote the flexibility of each attachment tab 58.

Each clamp 60 is arranged at a lower end of a lower portion of each attachment tab 58 that extends axially projecting from a lower edge of the upper segment formed in the peripheral wall 50.

The attachment tabs 58 are here two in number and they are arranged diametrically opposite to the main axis O of the case 10.

The notches 62 are here arranged in line with the indentations 48 as shown in FIG. 6. The notches 62 are more particularly arranged below the bearing face 36. The notches 62 are accessible to the tabs 58 by means of passages realized in the shoulder face 49. The upper segment of each tab 58 is arranged in coincidence with an indentation 48. This upper segment has a lateral face 65 for gripping the attachment ring 28, which is accessible through the indentation 48. Each lateral gripping face 65 is thus formed by a segment of the external face of the peripheral wall 50 of the attachment ring 28. This arrangement allows a user to bias the attachment tabs 58 towards their disengaged state by biasing them directly with their fingers through the indentations 48 by radial pinching. Thus, the attachment ring 28 can be easily removed.

In order to allow the attachment ring 28 to be correctly positioned with respect to the pedestal 24, the attachment ring 28 comprises means for angular indexing by cooperation with the indentations 48.

The angular indexing means comprise at least one projection 66 that extends radially outward from the lateral gripping face 65 of at least one attachment tab 58, in this case both attachment tabs 58. The projection 66 is axially nested with the associated indentation 48. These projections 66 come in abutment against the upper edge 35 of the cylindrical wall 32 of the pedestal 24 when they are not aligned with an indentation 48. Each projection 66 here has a thickness equal to the thickness of the cylindrical wall 32 of the pedestal 24. In particular, this allows to ensure that the projection 66 does not interfere with the screwing of the cover 12.

The projections 66 also allow the ring 28 to be immobilized in rotation about the main axis O with respect to the pedestal 24.

The cover 12 for closing the housing 29 is intended to be screwed onto the thread 34 of the pedestal 24 between a fully unscrewed position, as shown in FIG. 2, and a fully screwed position, as shown in FIG. 1, in which it is brought axially closer to the sifter 22 to allow the cavity 16 to be sealed. The screwing is done by rotating the cover 12 around the main axis O of the case 10.

To facilitate the recycling of the case 10, the attachment ring 28 and the pedestal 24 are made of one or more materials that can be processed by the same recycling stream.

Preferably, the pedestal 24 and the attachment ring 28 are made of a plastic material.

The plastic material may be selected from polypropylene (PP), recycled polypropylene (R-PP), polyethylene terephthalate (PET), recycled polyethylene terephthalate (R-PET), thermoplastic elastomer (TPE), polyethylene (PE), such as the low density polyethylene (LDPE) and/or the high density polyethylene (HDPE), composite material, post-consumer recycled material (PCR and/or similar material). Preferably, it is polypropylene and/or polyethylene terephthalate, whether recycled or not.

Advantageously, all the parts, namely the pedestal 24, the attachment ring 28 and the cover 12, are made of a plastic material selected from polypropylene and/or polyethylene terephthalate.

In addition, the use of plastic materials, especially similar plastic materials for the entire pot, allows to facilitate the recycling. In particular, the polypropylene and the polyethylene terephthalate are two plastic materials whose recycling cycle is well known.

The pedestal 24, the attachment ring 28 and the cover 12 can be made in 3D printing. Such a printing method allows in particular to realize very freely these parts presenting patterns and shapes participating to the aesthetic aspect of the case 10.

The attachment ring 28 and the pedestal 24 are made of polypropylene (PP), for example.

When replacing a container 26, the cover 12 of the case 10 is first removed. Then the user places the base 14 by its bottom 41 in one hand, leaving the cylindrical wall 32 accessible. With the other hand, he pinches between two fingers the upper segments of the diametrically opposed attachment tabs 58 through the indentations 48. This same gesture allows the user to grasp the attachment ring 28. With the tabs 58 thus constrained to their disengaged state, the user can freely slide the attachment ring 28 axially upwards so as to extract it from the housing 29.

Then, after having removed the attachment ring 28, the user grasps the container 26 between two fingers of his free hand by its rims 46 through the indentations 48. He can then lift the container 26 equipped with its sifter 22 to extract it from its housing 29. Because the frame 44 makes the upper edge 42 of the container 26 sufficiently rigid, the container 26 does not deform and the cosmetic product remaining inside the container 26 does not spill out.

This arrangement therefore allows for safe handling of the container 26 with flexible walls.

The user can then insert a new container 26 equipped with its sifter 22 into the housing 29 by gripping it by its rim 46 between two diametrically opposed fingers. The fingers can accompany the container 26 through the indentations 48 until it is placed on the bearing face 36.

The user can then insert the attachment ring 28 into the upper section 31 of the housing 29 to attach the new container 26 in place. The projections 66 allow the attachment ring 28 to be correctly oriented so that the attachment tabs 58 are inserted in coincidence with the indentations 48 for being snap fitted in an automatic manner with their notch 62. To do this, the user simply pushes the attachment ring 28 axially downwards. To this end, the clamps 60 are, for example, equipped with an inclined ramp that allows them to automatically flex upon contact as they slide towards the notch 62 before being elastically returned to their fitted state once they face the notch 62.

The invention thus allows a user to cleanly and quickly replace a container 26 with very flexible wall.

The invention claimed is:

1. A case for powder cosmetic product comprising a base and a cover for closing the base, the base comprising:

a pedestal comprising a housing configured to open axially upwards, an upper section of the housing being delimited radially by a cylindrical wall and axially downwards by an annular bearing face;

a container enclosing a cavity that contains said powder cosmetic product, the container being releasably received in the housing, the container comprising an axial opening surrounded by a rim that rests on the annular bearing face; and an attachment ring for attaching the container by tightening the rim of the container against the annular bearing face; wherein the cylindrical wall comprises at least two opposite indentations which give access to at least the rim of the container, the attachment ring being attached by removable attachment means in the housing, two lateral gripping faces for gripping the attachment ring being accessible through the at least two opposite indentations, the attachment ring comprising means of angular indexing of the attachment ring by cooperation with the at least two opposite indentations.

2. The case according to claim 1, wherein the attachment ring is attached to the pedestal by attachment means by snap fitting in an axial direction.

3. The case according to claim 2, wherein the attachment ring comprises two axial extension tabs which are elastically deformable inflexion and which are intended to be snap fitted with two notches carried by the pedestal in order to form said attachment means by snap fitting.

4. The case according to claim 3, wherein the notches are arranged in line with the at least two opposite indentations, each of the two axial extension tabs having an upper segment comprising one of the two gripping faces which is arranged in coincidence with one of the at least two opposite indentation, the two axial extension tabs being capable of being constrained towards a state of disengagement of the notches by radial pinching of the upper segment of the two axial extension tabs through the at least two opposite indentations.

5. The case according to claim 4, wherein the angular indexing means comprise at least one projection which extends from the gripping face of each of the two axial extension tabs and which is axially nested with one of the at least two opposite indentations.

6. The case according to claim 1, wherein the container comprises a flexible sifter which is stretched across the axial opening.

7. The case according to claim 6, wherein the sifter is attached to the rim of the container by means of a frame.

8. The case according to claim 7, wherein a periphery of the frame has a sealing lip against which the attachment ring is intended to be tightened.

9. The case according to claim 8, wherein the container has at least one wall sufficiently flexible so that a bottom wall of the container can be easily lifted by a finger of a user up to come into contact with the sifter.

10. The case according to claim 1, wherein a bottom of the pedestal has a window for access to a bottom wall of the container.

11. The case according to claim 1, wherein the entire height of the attachment ring is housed in the cylindrical wall of the pedestal hiding a peripheral wall of the attachment ring.

12. The case according to claim 11, wherein:

the attachment ring is attached to the pedestal by attachment means by snap fitting in an axial direction;

the attachment ring comprises two axial extension tabs which are elastically deformable in flexion and which are intended to be snap fitted with two notches carried by the pedestal in order to form said attachment means by snap fitting;

the two notches are arranged in line with the at least two opposite indentations, each of the two axial extension tabs having an upper segment comprising the gripping face which is arranged in coincidence with one of the at least two opposite indentation, the two axial extension tabs being capable of being constrained towards a state of disengagement of the notches by radial pinching of their upper segment through the at least two opposite indentations; and each of the two the gripping faces is formed by a segment of the peripheral wall.

* * * * *